US007051794B2

(12) United States Patent
Luo

(10) Patent No.: US 7,051,794 B2
(45) Date of Patent: May 30, 2006

(54) VAPOR-LIQUID SEPARATING TYPE HEAT PIPE DEVICE

(76) Inventor: Chin-Kuang Luo, 5F, No. 56, Min-Chuan Rd., Chung Dist, Taichung City (TW)

( * ) Notice: Subject to any disclaimer, the term of this patent is extended or adjusted under 35 U.S.C. 154(b) by 0 days.

(21) Appl. No.: 10/891,629

(22) Filed: Jul. 15, 2004

(65) Prior Publication Data

US 2005/0019234 A1 Jan. 27, 2005

(30) Foreign Application Priority Data

Jul. 21, 2003 (TW) ..... 92119854 A

(51) Int. Cl.
*F28D 15/00* (2006.01)

(52) U.S. Cl. ..... 165/104.26; 165/104.33; 361/697; 361/700; 174/15.2; 257/715

(58) Field of Classification Search ..... 165/104.26, 165/104.33, 104.21; 361/699, 700; 257/714–715; 174/15.1, 15.2
See application file for complete search history.

(56) References Cited

U.S. PATENT DOCUMENTS

| | | | | |
|---|---|---|---|---|
| 3,568,762 | A * | 3/1971 | Harbaugh | 165/104.26 |
| 3,651,240 | A * | 3/1972 | Kirkpatrick | 219/78.02 |
| 3,986,550 | A * | 10/1976 | Mitsuoka | 165/104.21 |
| 4,036,291 | A * | 7/1977 | Kobayashi et al. | 165/104.21 |
| 4,058,159 | A * | 11/1977 | Iriarte | 165/104.26 |
| 4,554,966 | A * | 11/1985 | Vasiliev et al. | 165/104.21 |
| 4,693,306 | A * | 9/1987 | Nilson | 165/104.21 |
| 5,036,908 | A * | 8/1991 | Petroff et al. | 165/104.21 |
| 5,046,553 | A * | 9/1991 | Lindner | 165/104.26 |
| 5,412,535 | A * | 5/1995 | Chao et al. | 361/700 |
| 5,529,115 | A * | 6/1996 | Paterson | 165/104.33 |
| 5,582,242 | A * | 12/1996 | Hamburgen et al. | 165/104.21 |
| 5,632,158 | A * | 5/1997 | Tajima | 62/259.2 |
| 6,019,167 | A * | 2/2000 | Bishop et al. | 165/104.33 |
| 6,336,497 | B1 * | 1/2002 | Lin | 165/80.3 |
| 6,725,909 | B1 * | 4/2004 | Luo | 165/104.21 |
| 6,793,009 | B1 * | 9/2004 | Sarraf | 165/104.33 |
| 6,827,133 | B1 * | 12/2004 | Luo | 165/104.21 |
| 6,907,918 | B1 * | 6/2005 | Connors et al. | 165/104.26 |
| 2003/0183372 | A1 * | 10/2003 | Lai et al. | 265/104.26 |

FOREIGN PATENT DOCUMENTS

| | | | | |
|---|---|---|---|---|
| JP | 60-103296 | * | 6/1985 | 165/104.21 |

* cited by examiner

*Primary Examiner*—Terrell McKinnon
(74) *Attorney, Agent, or Firm*—Trop, Pruner & Hu, PC

(57) ABSTRACT

A vapor-liquid separating type heat pipe device includes a heat sink member mountable on a heat source, tubular outer and inner bodies, a heat transfer fluid, a top vapor passage, and a bottom liquid passage. The outer body has an outer peripheral wall defining an inner chamber. The inner body is disposed in the inner chamber, and has an inner peripheral wall defining thereinside an evaporating space and cooperating with the outer peripheral wall to define a condensing space therebetween. The fluid is introduced into the inner chamber. The vapor passage is provided between and is in fluid communication with the evaporating and condensing spaces. The liquid passage is provided between and is in fluid communication with the condensing space and the heat sink member. The vapor and liquid passages are located proximate to the top and bottom ends of the inner and outer bodies, respectively.

10 Claims, 11 Drawing Sheets

VAPOR-LIQUID SEPARATING TYPE HEAT PIPE DEVICE

CROSS-REFERENCE TO RELATED APPLICATION

This application claims priority of Taiwanese Application No. 092119854, filed on Jul. 21, 2003.

BACKGROUND OF THE INVENTION

1. Field of the Invention

The invention relates to a heat pipe device, more particularly to a vapor-liquid separating type heat pipe device that can dissipate heat quickly.

2. Description of the Related Art

Referring to FIGS. 1 to 3, a conventional heat pipe device includes an outer body 1, an inner body 2, and a heat transfer fluid 300.

The outer body 1 has an open end 11, and an outer wall 12 defining a first receiving space 13. An inner wall surface of the outer wall 12 is formed with a capillary structure 14. The capillary structure 14 includes a plurality of spaced-apart protruding pieces 141 formed and distributed evenly on the inner wall surface of the outer wall 12.

The inner body 2 is disposed in the outer body 1, and has an inner wall 21 defining a second receiving space 22. The inner and outer wall surfaces of the inner wall 21 are formed respectively with capillary structures 23. Each capillary structure 23 includes a plurality of spaced-apart protruding pieces 231 formed and distributed evenly on a respective one of the inner and outer wall surfaces of the inner wall 21.

The heat transfer fluid 300 is introduced into the first and second receiving spaces 13, 22, respectively.

After the inner body 2 is filled with the heat transfer fluid 100, it is placed in the first receiving space 13, after which the fluid 300 is continuously filled into the first receiving space 13, as shown in FIG. 2. Then, the open end 11 of the outer body 1 is sealed, thereby sealing the inner body 2 and the heat transfer fluid 300 inside the outer body 1.

In use, after a heat absorbing side of the conventional heat pipe device is pressed by a machine tool (not shown), it is mounted on a heat source 200, as shown in FIG. 3. When the rising temperature of the heat source 200 stimulates the heat transfer fluid 300 in the first and second receiving spaces 13, 22, the fluid 300 gradually absorbs the heat and vaporizes to form a high-pressure vapor. Then, through a pressure difference, the vapor flows from the heat absorbing side to the other side of the conventional heat pipe device so as to exchange heat with the ambient space by convection, and subsequently condenses and flows back to the heat absorbing side, thereby achieving a continuous cycle of heat exchange effect.

Although the conventional heat pipe device has first and second receiving spaces 13, 22 to effect dual-passage heat exchange, the first and second receiving spaces 13, 22 operate separately so that each of them provides only a single flow passage for both vapor and condensed liquid. This entails entrainment problem between vapor and liquid. Moreover, when the heat flux is excessive, a dryout phenomenon can occur in the conventional heat pipe device.

SUMMARY OF THE INVENTION

Therefore, the object of the present invention is to provide a vapor-liquid separating type heat pipe device that can dissipate heat quickly and that is capable of overcoming the aforementioned drawbacks of the prior art.

According to this invention, a vapor-liquid separating type heat pipe device comprises a heat sink member adapted to be mounted on a heat source, a tubular outer body, a tubular inner body, a heat transfer fluid, a top vapor passage, and a bottom liquid passage. The tubular outer body has a bottom end connected to the heat sink member so as to close the bottom end, a top end opposite to the bottom end, an outer peripheral wall between the bottom and top ends, and an inner chamber defined by the outer peripheral wall above the heat sink member. The tubular inner body is disposed in the inner chamber, and has opposite top and bottom ends, and an inner peripheral wall between the top and bottom ends and defining thereinside an evaporating space. The inner peripheral wall is spaced apart from and cooperates with the outer peripheral wall to define a condensing space therebetween. The heat transfer fluid is introduced into the inner chamber. The top vapor passage is provided between and is in fluid communication with the evaporating space and the condensing space, and is located proximate to the top ends of the inner and outer bodies. The bottom liquid passage is provided between and is in fluid communication with the condensing space and the evaporating space, and is located proximate to the bottom ends of the inner and outer bodies.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
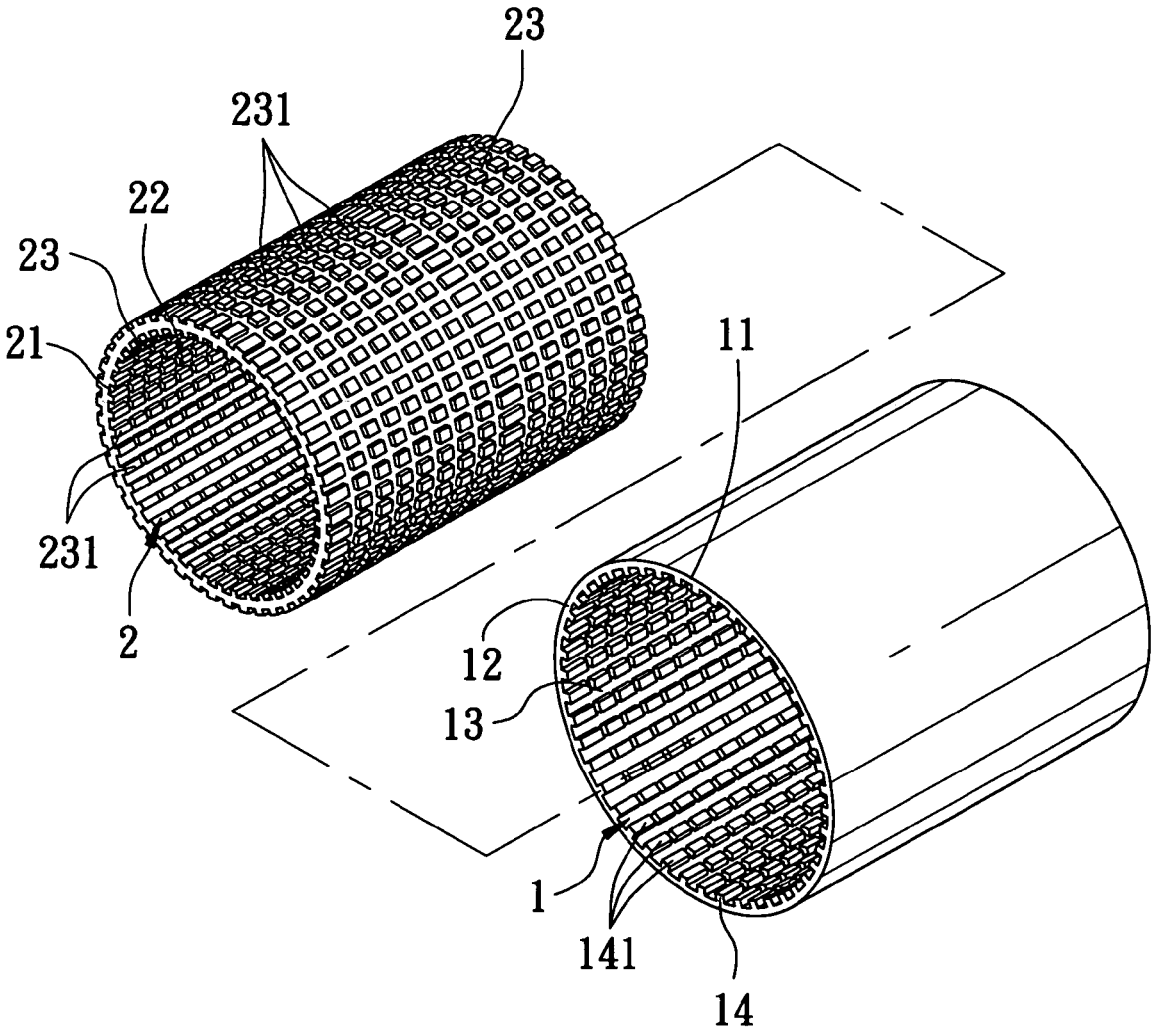
FIG. 1 PRIOR ART
FIG. 1 is an exploded perspective view of a conventional heat pipe device.

Before the present invention is described in greater detail, it should be noted that like elements are denoted by the same reference numerals throughout the disclosure.

Figure 4:
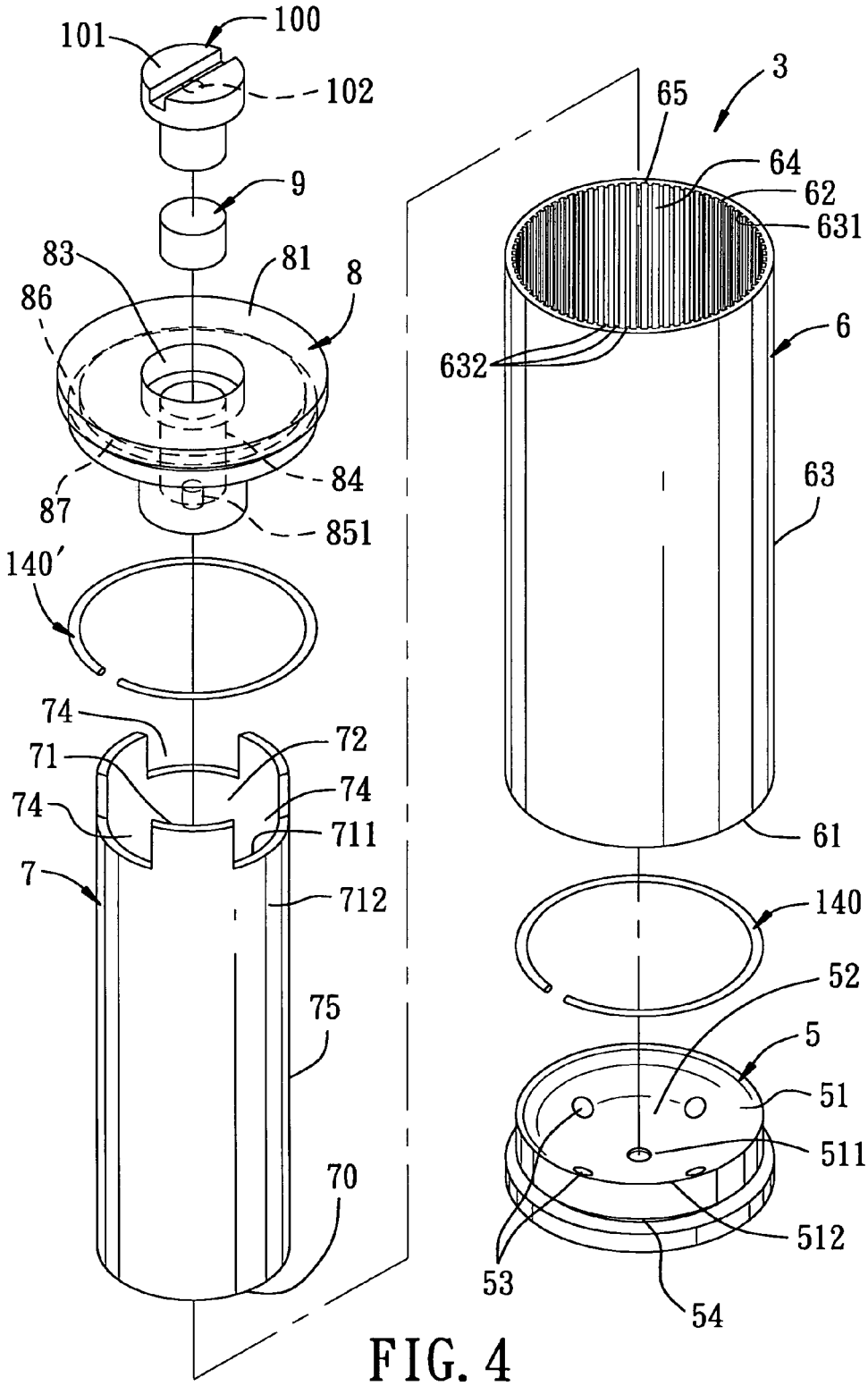
FIG. 4 is an exploded perspective view of the first preferred embodiment of a vapor-liquid separating type heat pipe device according to the present invention.
Figure 5:
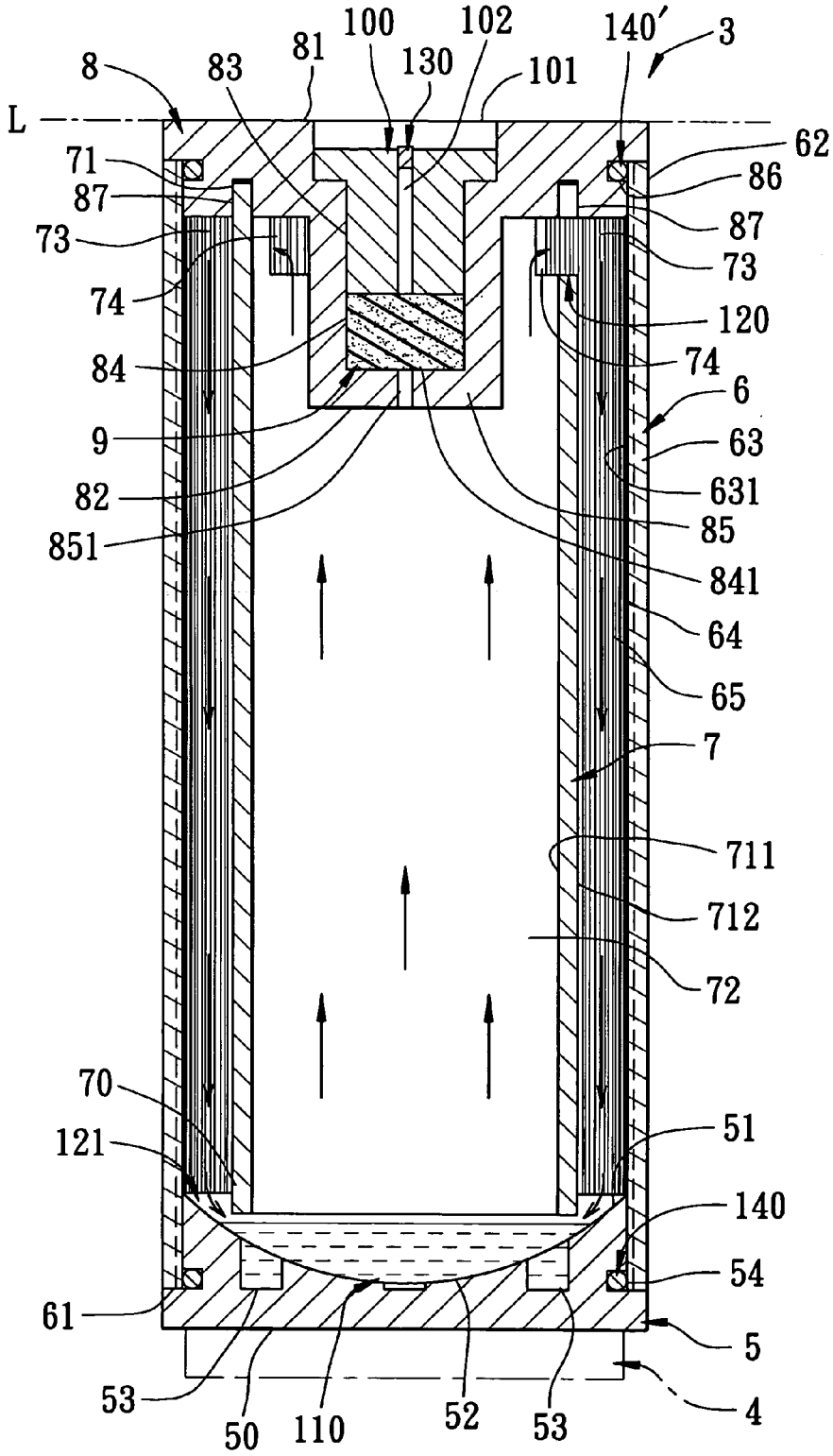
FIG. 5 is an assembled sectional view of the first preferred embodiment in a state of use.
Figure 6:
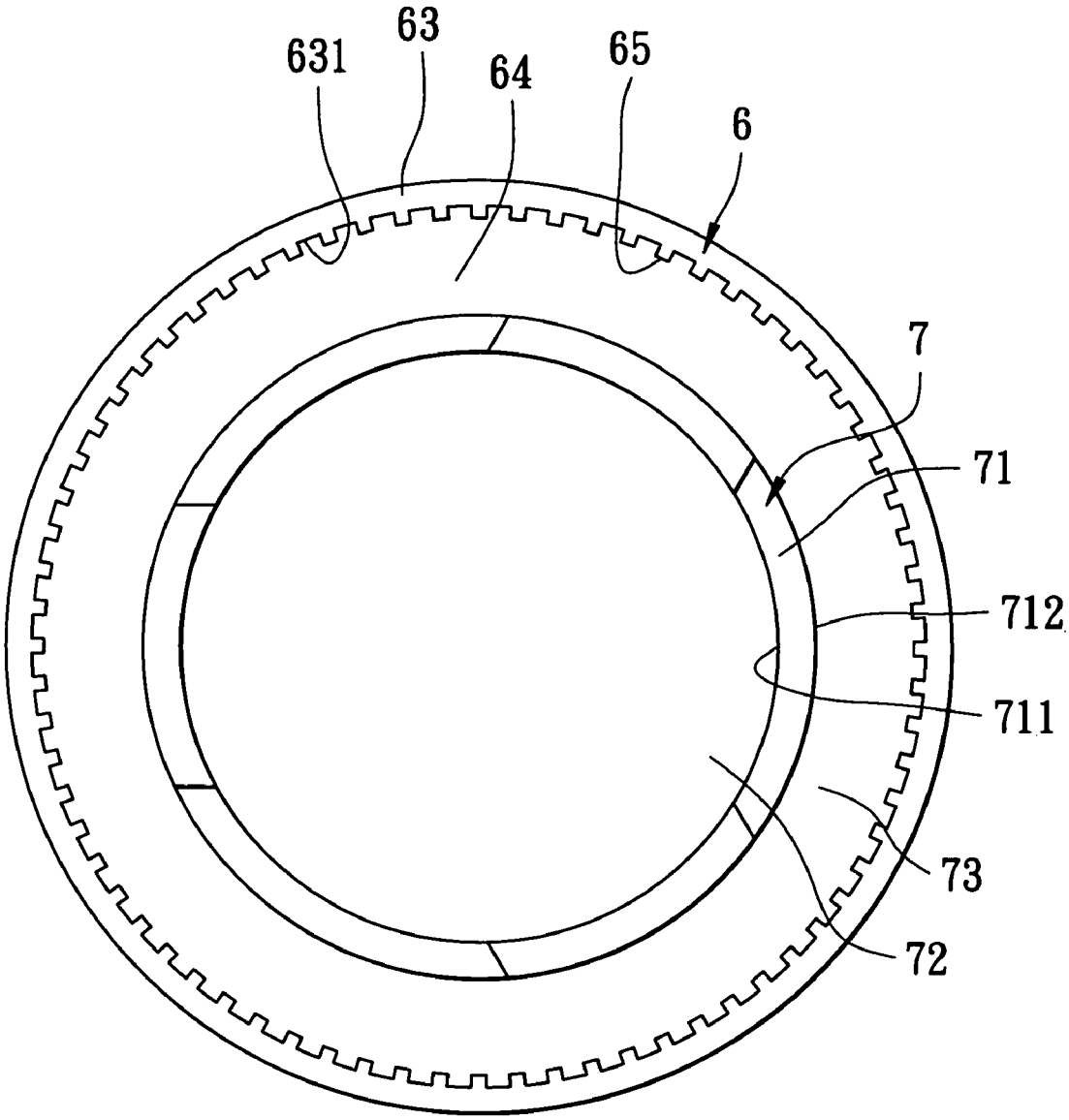
FIG. 6 is a top schematic view, illustrating an assembly of tubular outer and inner bodies of the first preferred embodiment.

Referring to FIGS. 4, 5 and 6, the first preferred embodiment of a vapor-liquid separating type heat pipe device 3 according to the present invention is shown to comprise a heat sink member 5, a tubular outer body 6, a tubular inner body 7, a cover member 8, a top vapor passage 120, a bottom liquid passage 121, an elastic sealing member 9, a securing member 100, and a heat transfer fluid 110.

The heat sink member 5 is adapted to be mounted on a heat source 4 (see FIG. 5), such as a central processing unit, and is made of a good heat conductive material, such as aluminum, copper or a metal alloy. The heat sink member 5 has a bottom face 50 (see FIG. 5) adapted to be in contact with the heat source 4, and a top face 51 opposite to the bottom face 50 and indented downwardly to define a fluid accumulating portion 52. The top face 51 is indented from a peripheral end 512 to a central part 511 so that the heat sink member 5 decreases in thickness from the peripheral end 512 to the central part 511. The fluid accumulating portion 52 includes a plurality of spaced-apart downward slots 53 formed in the top face 51.

The tubular outer body 6 is made of a good heat conductive material, such as aluminum, copper or a metal alloy, and has a bottom end 61 connected to the heat sink member 5 so as to close the bottom end 61, a top end 62 opposite to the bottom end 61, an outer peripheral wall 63 between the bottom and top ends 61, 62, and an inner chamber 64 defined by the outer peripheral wall 63 above the heat sink member 5. The top face 51 of the heat sink member 5 is directed toward the inner chamber 64. The outer peripheral wall 63 has an inner wall surface 631 formed with a capillary structure 65. In this embodiment, the capillary structure 65 includes a plurality of vertically extending internal wicks 632, which project radially from the inner wall surface 631. In an alternative embodiment, the capillary structure 65 may include a plurality of spiral capillary grooves (not shown).

The heat sink member 5 further has a peripheral face extending between the top and bottom faces 51, 50 and engaging the inner wall surface 631 of the outer peripheral wall 63 at the bottom end 61 of the outer body 6. The peripheral face is recessed to form a peripheral groove 54, and has a first braze metal wire 140 (see FIG. 5) which is received in the groove 54 and which is fused to join the heat sink member 5 to the outer body 6.

The tubular inner body 7 is disposed in the inner chamber 64, and is made of a good heat conductive material, such as aluminum, copper or a metal alloy. The inner body 7 has opposite top and bottom ends 71, 70, an inner peripheral wall 75 between the top and bottom ends 71, 70 and a cutout portion 74. The bottom end 70 of the inner body 7 is spaced apart from the heat sink member 5. The inner peripheral wall 75 has an inner wall surface 711 defining thereinside an evaporating space 72, and an outer wall surface 712 that is spaced apart from and that cooperates with the inner wall surface 631 of the outer peripheral wall 63 to define a condensing space 73 therebetween. In this embodiment, the inner body 7 has three spaced-apart cutout portions 74 formed in the top end 71 of the inner body 7 and in fluid communication with the evaporating space 72 and the condensing space 73.

The top vapor passage 120 is provided between and is in fluid communication with the evaporating space 72 and the condensing space 73, and is located proximate to the top ends 71, 62 of the inner and outer bodies 7, 6. Each of the cutout portions 74 serves as the vapor passage 120.

The bottom liquid passage 121 is formed between and is in fluid communication with the condensing space 73 and the evaporating space 72, and is disposed between the bottom end 70 of the inner body 7 and the heat sink member 5.

The cover member 8 covers the top end 62 of the outer body 6, and has an inner side 82 facing the inner chamber 64, an outer side 81 opposite to the inner side 82, a filling hole 83, and a retaining slot 87. The filling hole 83 is formed in the cover member 8, is in fluid communication with the inner chamber 64, and extends through the outer side 81. The filling hole 83 is formed as a blind hole 84 which opens at the outer side 81 and which has a closed end 841 adjacent to the inner side 82. The cover member 8 further has a seat part 85 at the inner side 82 to bound the closed end 841. The seat part 85 has a first needle hole 851 extending through the inner side 82 and communicated with the blind hole 84. The blind hole 84 has a cross-section, which is gradually reduced from the outer side 81 to the inner side 82.

The retaining slot 87 faces the inner chamber 64, and receives securely the top end 71 of the inner body 7 therein so that the inner body 7 is hung on the cover member 8 inside the outer body 6. In this embodiment, the top end 71 of the inner body 7 is welded securely in the retaining slot 87.

The cover member 8 further has a peripheral face extending between the outer and inner sides 81, 82 and engaging the inner wall surface 631 of the outer peripheral wall 63 at the top end 62 of the outer body 6. The peripheral face of the cover member 8 is recessed to form a peripheral groove 86, and has a second braze metal wire 140' that is received in the groove 86 in the cover member 8 and that is fused to join the cover member 8 to the outer body 6. In an alternative embodiment, the heat sink member 5 and the cover member 8 can be fitted sealingly and respectively to the bottom and top ends 61, 62 of the outer body 6 by a machine tool (not shown), or can be engaged threadedly and respectively to the bottom and top ends 61, 62 of the outer peripheral wall 63 of the outer body 6.

In this embodiment, the elastic sealing member 9 is a cured sealing block fitted within the filling hole 83, and is made of an elastic material, such as a rubber or a silicone elastomer. The sealing member 9 is pierceable by a needle (not shown) to provide a passage (not shown) for injection of the heat transfer fluid 110 through the sealing member 9, and is contractible to seal the passage.

The securing member 100 is fitted sealingly into the blind hole 84 and outwardly of the sealing member 9 by means of a tool (not shown) so as to press the sealing member 9 against the seat part 85 so that an outer surface 101 of the securing member 100 is flush with the outer side 81 of the cover member 8, as shown by the straight line (L) in Figures, thereby forming a flat-nozzle heat pipe device 3, and thereby sealing the first needle hole 851 and preventing air from entering the inner chamber 64. The securing member 100 has a second needle hole 102 in alignment with the first needle hole 851, and an insert piece 130 (see FIG. 5) disposed sealingly in the second needle hole 102. The insert piece 130 may be a welding spot formed by a spot welding machine (not shown), or a sealant.

The heat transfer fluid 110 is a conventional fluid that vaporizes when heated and that condenses when cooled. The fluid 110 is introduced into the inner chamber 64, and is accumulated in the fluid accumulating portion 52.

To fill the inner chamber 64 with the heat transfer fluid 110, the needle is connected to a controlling unit (not shown), which operates subsequently to evacuate air from within the inner chamber 64 and to introduce a predetermined amount of the heat transfer fluid 110 into the inner chamber 64. The needle is extended into the inner chamber 64 by passing through the second needle hole 102 in the securing member 100, the sealing member 9, and the first needle hole 851. The fluid 110 is accumulated in the fluid accumulating portion 52 of the heat sink member 5. When the needle is withdrawn from the outer body 6 and the second needle hole 102, the second needle hole 102 is closed by the insert piece 130 for enhanced airtight sealing.

Figure 2:
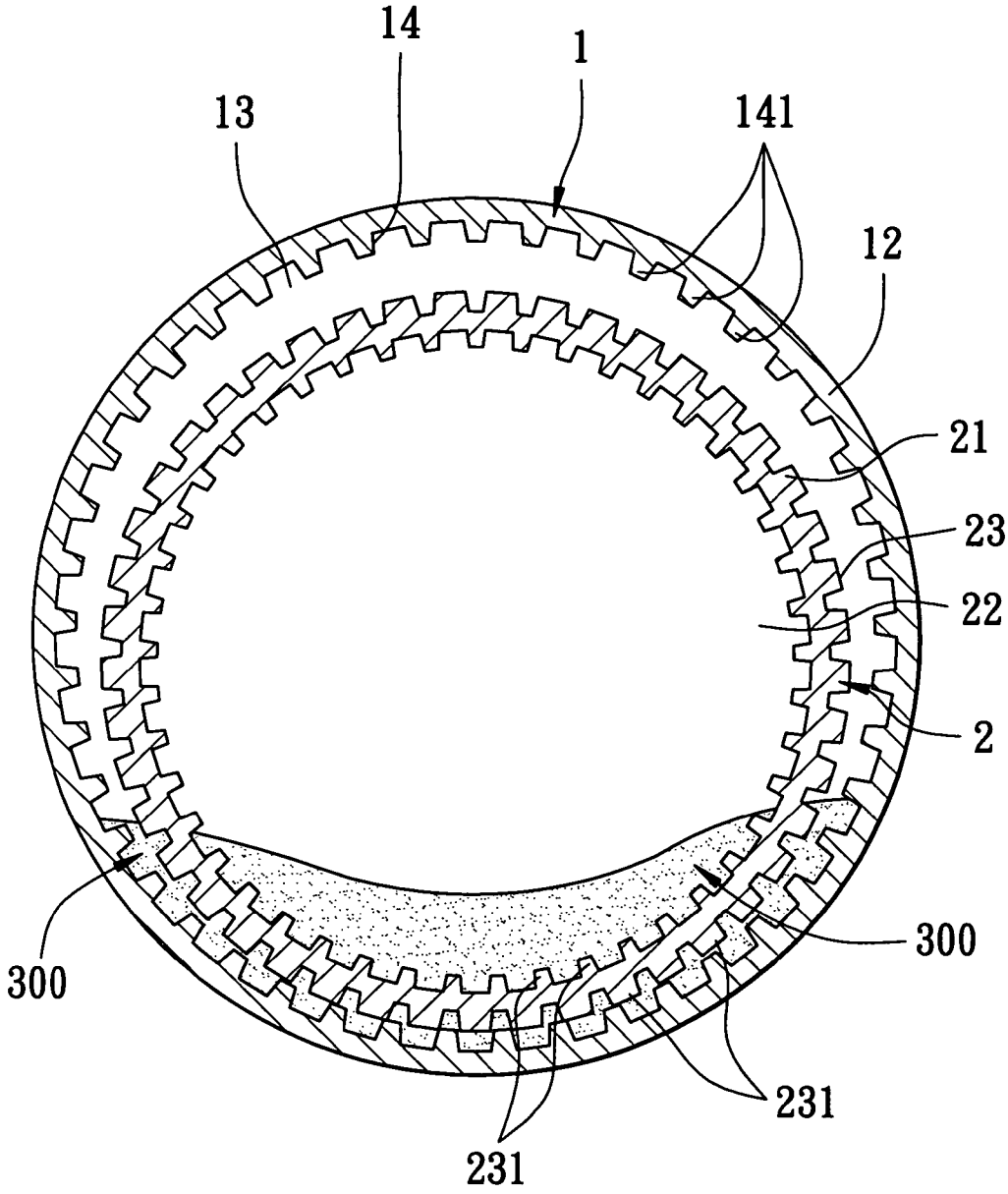
FIG. 2 PRIOR ART
FIG. 2 is a sectional view of the conventional heat pipe device in an assembled state.
Figure 3:
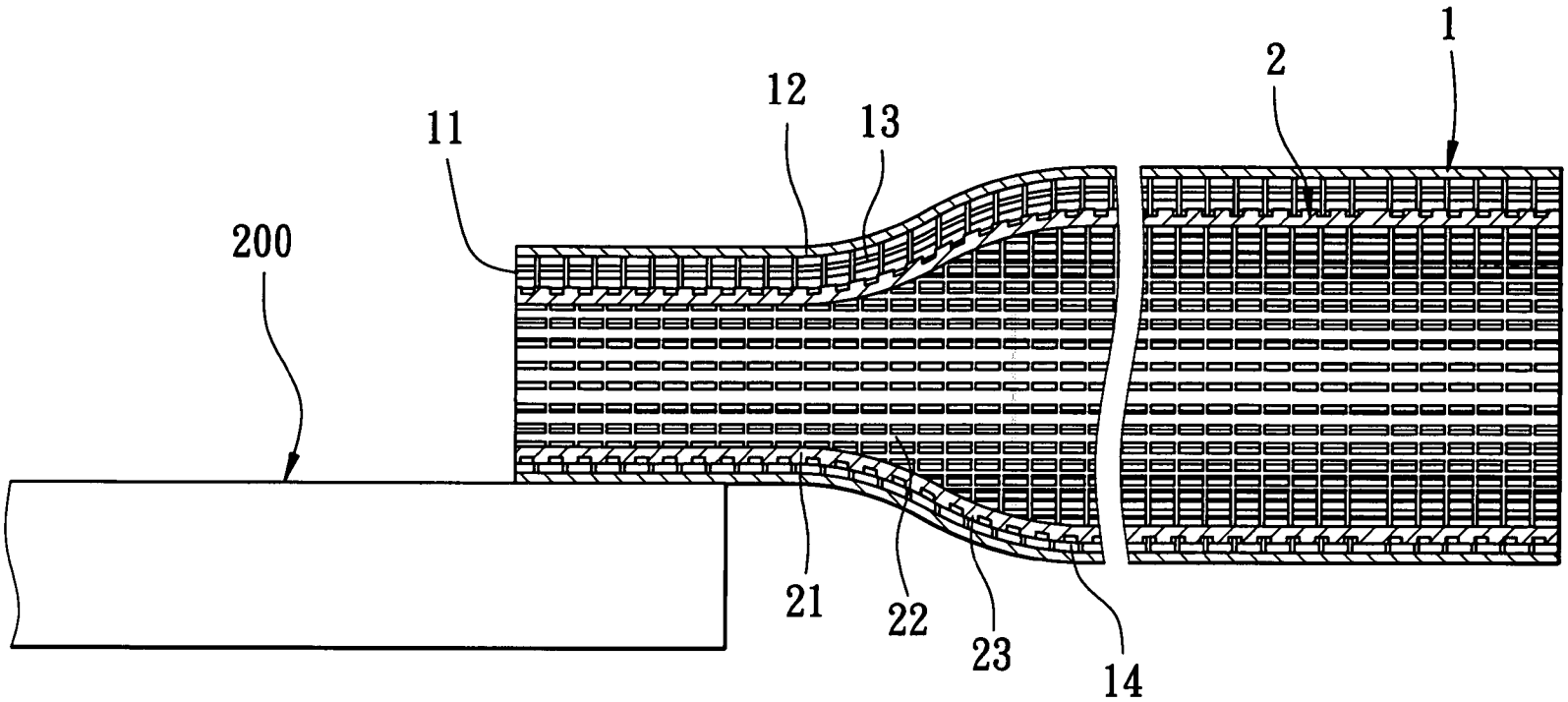
FIG. 3 PRIOR ART
FIG. 3 is a sectional view of the conventional heat pipe device in a state of use.

In use, when the temperature of the heat source 4 rises, the heat transfer fluid 110 in the fluid accumulating portion 52 is stimulated and changes phase quickly, that is, from liquid to high-pressure vapor form. The fluid 110 absorbs the heat generated by the heat source 4 in the evaporating space 72, and vaporizes as shown by upward arrows in FIG. 5. The vaporized fluid flows from the evaporating space 72 to the condensing space 73 through the vapor passages 120. Through the capillary action of the capillary structure 65 in the inner wall surface 631 of the outer peripheral wall 63, and through heat exchange with the ambient space by convection, the vaporized fluid condenses and flows downward, as shown by downward arrows in FIG. 5, due to gravity to the fluid accumulating portion 52 through the liquid passage 121. As such, the flow passage for the vapor is separated from the flow passage for the liquid condensate so that the heat pipe device 3 of the present invention does not have the entrainment and dryout problems, which are encountered in the conventional heat pipe device shown in FIGS. 2 and 3.

Figure 7:
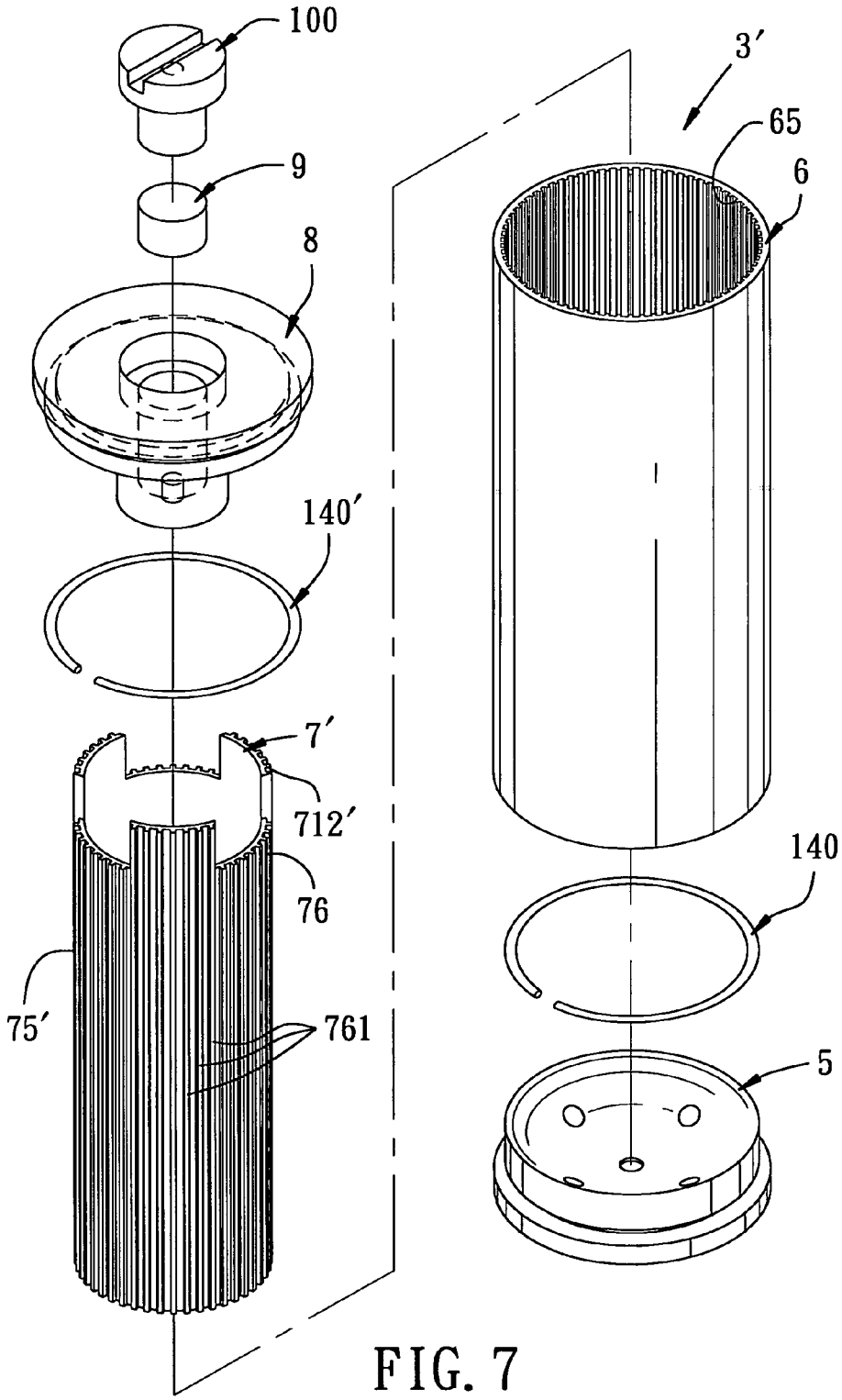
FIG. 7 is an exploded perspective view of the second preferred embodiment of a vapor-liquid separating type heat pipe device according to the present invention.
Figure 8:
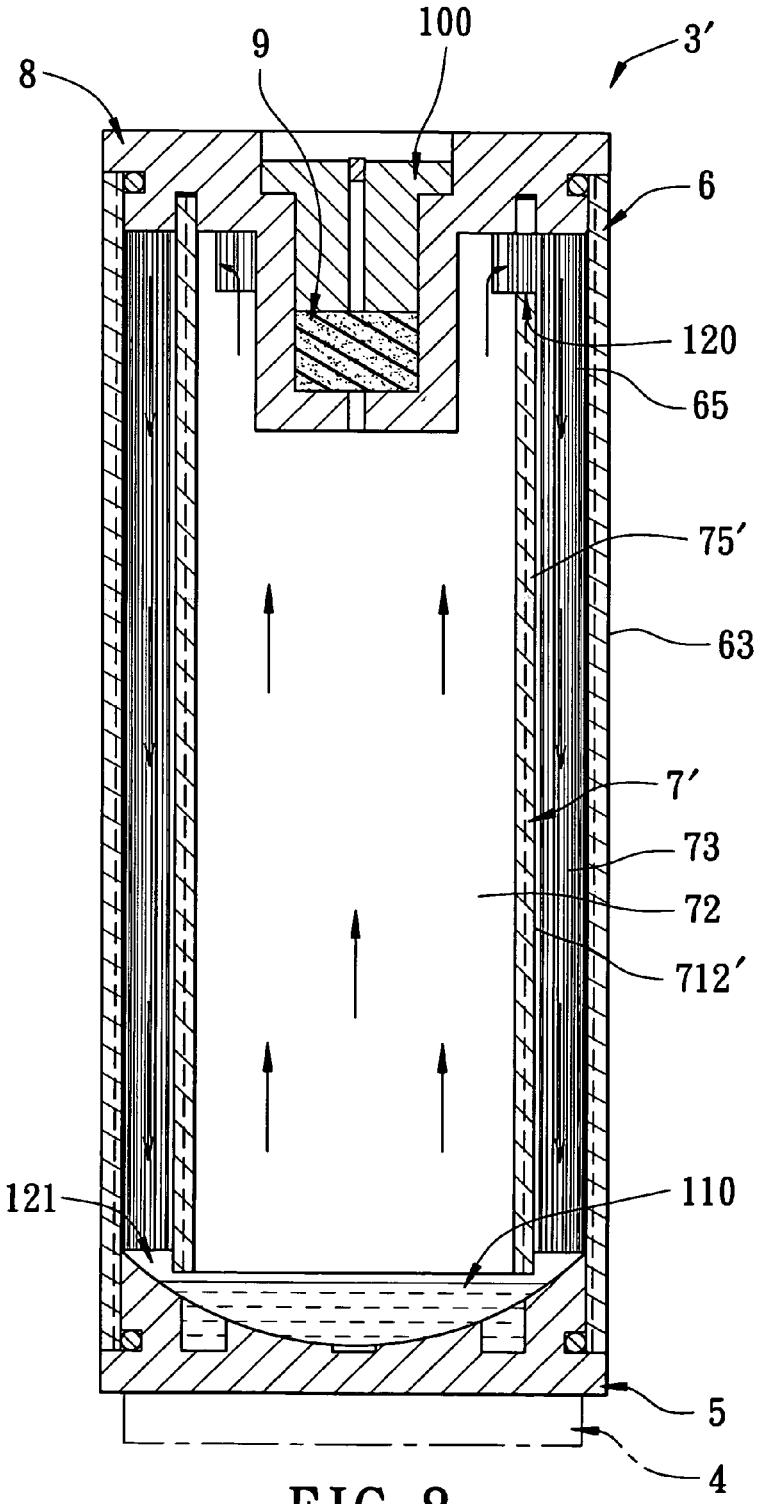
FIG. 8 is an assembled sectional view of the second preferred embodiment in a state of use.
Figure 9:
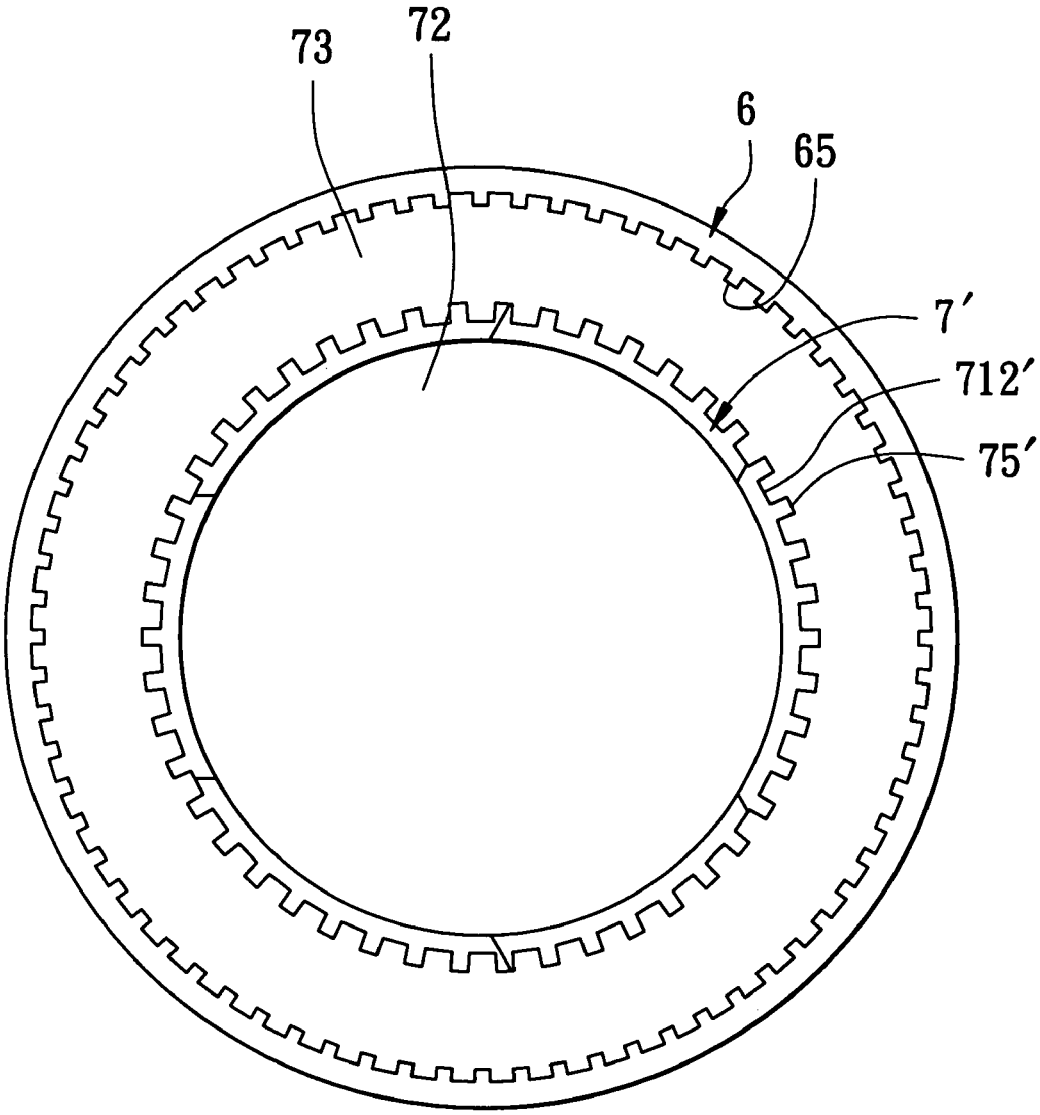
FIG. 9 is a top schematic view, illustrating an assembly of tubular outer and inner bodies of the second preferred embodiment.

Referring to FIGS. 7, 8 and 9, the second preferred embodiment of a vapor-liquid separating type heat pipe device 3' according to the present invention is shown to be substantially similar to the first preferred embodiment. However, in this embodiment, the inner peripheral wall 75' of the inner body 7' has an outer wall surface 712' formed with a capillary structure 76. In this embodiment, the capillary structure 76 includes a plurality of vertically extending internal wicks 761, which project radially and outwardly from the outer wall surface 712'. When the heat transfer fluid 110 absorbs the heat in the evaporating space 72 and vaporizes as shown by upward arrows in FIG. 8, the vaporized fluid flows to the condensing space 73 through the vapor passage 120. Through the capillary actions of the capillary structures 76, 65 in the respective inner and outer peripheral walls 75', 63, the vaporized fluid exchanges heat rapidly with the ambient space by convection, and subsequently condenses and flows downward, as shown by downward arrows in FIG. 8, due to gravity to the fluid accumulating portion 52 through the liquid passage 121. It is apparent that the heat exchange effect is enhanced in this embodiment.

Figure 10:
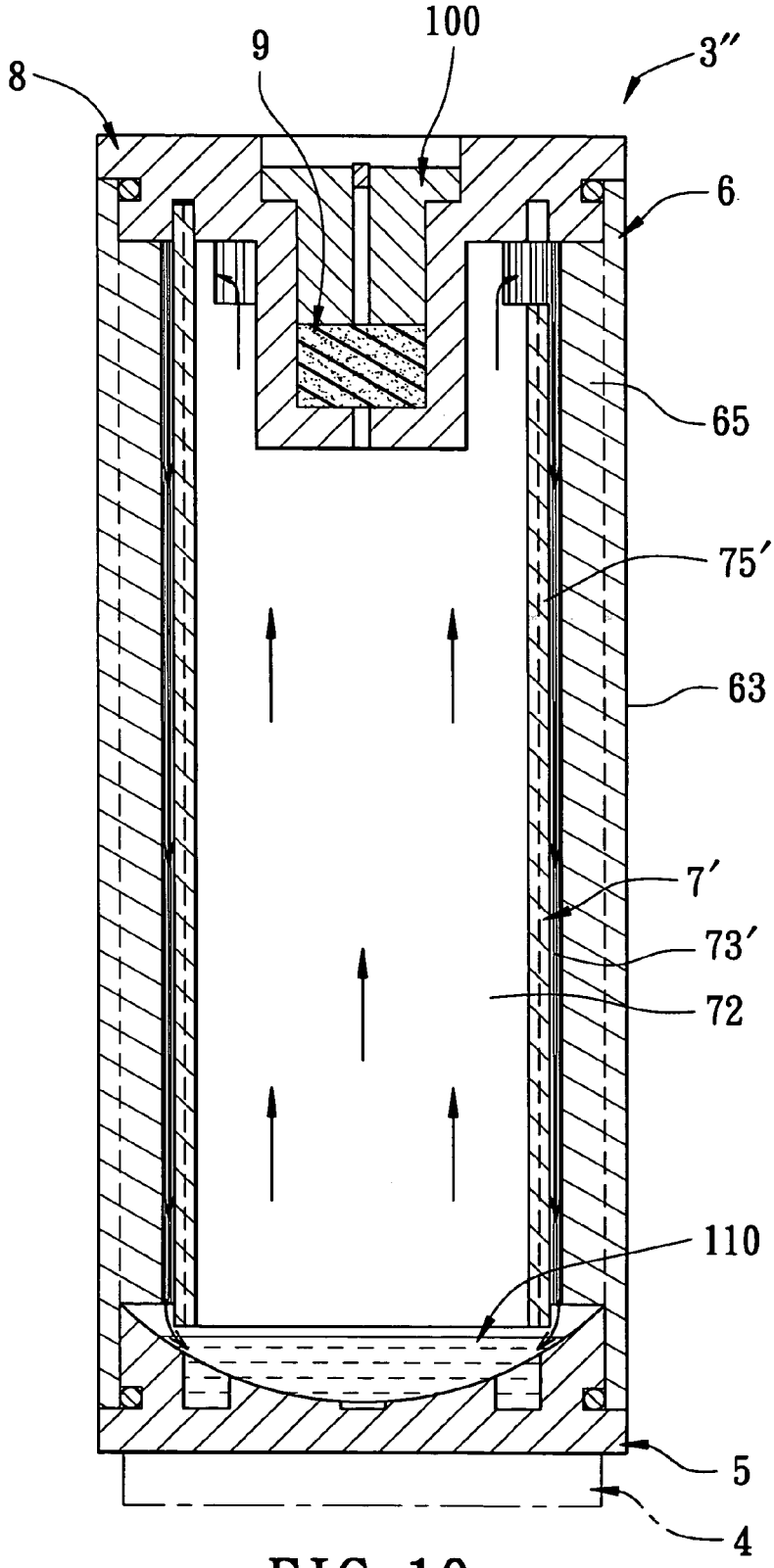
FIG. 10 is a sectional view of the third preferred embodiment of a vapor-liquid separating type heat pipe device according to the present invention in a state of use.
Figure 11:
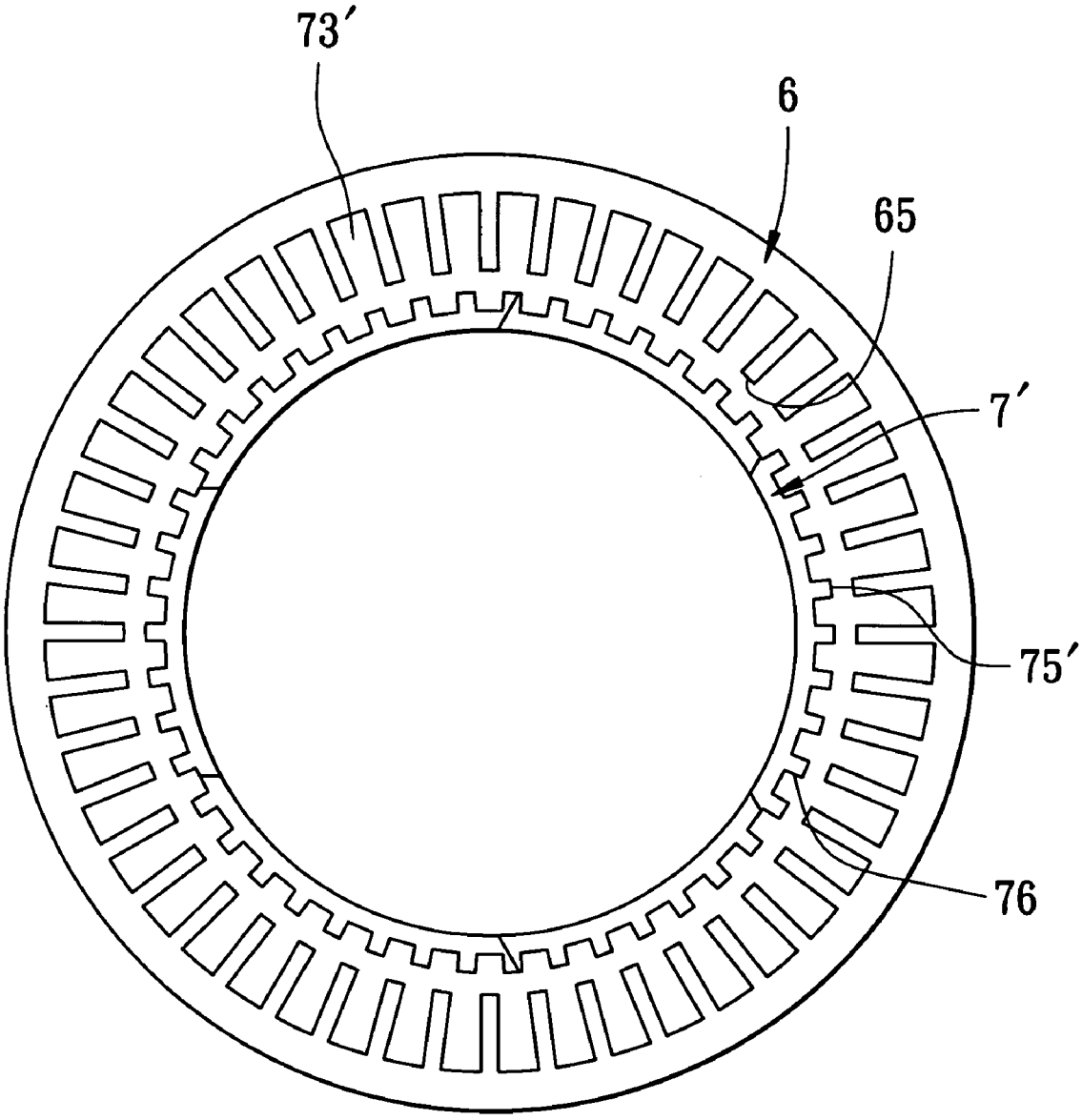
FIG. 11 is a top schematic view, illustrating an assembly of tubular outer and inner bodies of the third preferred embodiment.

Referring to FIGS. 10 and 11, the third preferred embodiment of a vapor-liquid separating type heat pipe device 3" according to the present invention is shown to be substantially similar to the second preferred embodiment. However, in this embodiment, the distance between the capillary structures 76, 65 in the inner and outer peripheral walls 75', 63 of the inner and outer bodies 7', 6 is reduced, thereby reducing the condensing space 73'.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A vapor-liquid separating type heat pipe device comprising:

a heat sink member adapted to be mounted on a heat source;

a tubular outer body having a bottom end connected to said heat sink member so as to close said bottom end, a top end opposite to said bottom end, an outer peripheral wall between said bottom and top ends, and an inner chamber defined by said outer peripheral wall above said heat sink member;

a tubular inner body disposed in said inner chamber, and having opposite top and bottom ends, and an inner peripheral wall between said top and bottom ends and defining thereinside an evaporating space, said inner peripheral wall being spaced apart from and cooperating with said outer peripheral wall to define a condensing space therebetween;

a heat transfer fluid introduced into said inner chamber;

a top vapor passage provided between and in fluid communication with said evaporating space and said condensing space, and located proximate to said top ends of said inner and outer bodies;

a bottom liquid passage provided between and in fluid communication with said condensing space and said evaporating space, and located proximate to said bottom ends of said inner and outer bodies; and a cover member covering said top end of said outer body, said inner body being hung on said cover member inside said outer body;

wherein said cover member includes a retaining slot facing said inner chamber, said inner body being fitted securely in said retaining slot.

2. The vapor-liquid separating type heat pipe device as claimed in claim 1, wherein said bottom end of said inner body is spaced apart from said heat sink member, said liquid passage being formed between said bottom end of said inner body and said heat sink member.

3. The vapor-liquid separating type heat pipe device as claimed in claim 1, wherein said inner body further has a cutout portion formed in said top end of said inner body and in fluid communication with said evaporating space and said condensing space, said cutout portion serving as said vapor passage.

4. The vapor-liquid separating type heat pipe device as claimed in claim 1, wherein said heat sink member has a top face indented downwardly to define a fluid accumulating portion, said heat transfer fluid being accumulated in said fluid accumulating portion.

5. The vapor-liquid separating type heat pipe device as claimed in claim 1, wherein said outer peripheral wall has an inner wall surface formed with a capillary structure.

6. The vapor-liquid separating type heat pipe device as claimed in claim 5, wherein said capillary structure includes a plurality of vertically extending internal wicks, which project radially from said inner wall surface.

7. The vapor-liquid separating type heat pipe device as claimed in claim 5, wherein said inner peripheral wall has an outer wall surface formed with a capillary structure.

8. The vapor-liquid separating type heat pipe device as claimed in claim 7, wherein said capillary structure includes a plurality of vertically extending internal wicks, which project radially and outwardly from said outer wall surface.

9. The vapor-liquid separating type heat pipe device as claimed in claim 1, wherein said inner peripheral wall has an outer wall surface formed with a capillary structure.

10. The vapor-liquid separating type heat pipe device as claimed in claim 9, wherein said capillary structure includes a plurality of vertically extending internal wicks, which project radially and outwardly from said outer wall surface.

* * * * *